US006364506B1

(12) United States Patent
Gallo

(10) Patent No.: US 6,364,506 B1
(45) Date of Patent: Apr. 2, 2002

(54) ADJUSTABLE UP-ANGLE LED LANTERN UTILIZING A MINIMAL NUMBER OF LIGHT EMITTING DIODES

(75) Inventor: Marc N. Gallo, Bayside, NY (US)

(73) Assignee: Julian A. McDermott Corporation, Ridgewood, NJ (US)

( * ) Notice: Subject to any disclaimer, the term of this patent is extended or adjusted under 35 U.S.C. 154(b) by 0 days.

(21) Appl. No.: 09/496,723

(22) Filed: Feb. 3, 2000

(51) Int. Cl.[7] ..... F21V 5/00

(52) U.S. Cl. ..... 362/245; 362/329; 362/347; 362/236

(58) Field of Search ..... 362/800, 235, 362/236, 245, 247, 249, 296, 297, 363, 341, 347, 329, 326

(56) References Cited

U.S. PATENT DOCUMENTS 5,105,347 A * 4/1992 Ruud et al. ..... 362/268
5,224,773 A 7/1993 Arimura
5,530,633 A * 6/1996 Yuen ..... 362/184
5,608,290 A 3/1997 Hutchisson et al.
5,642,933 A * 7/1997 Hitora ..... 362/243
5,838,247 A 11/1998 Bladowski
5,865,529 A 2/1999 Yan
5,929,788 A * 7/1999 Vukosic ..... 340/908.1

* cited by examiner

*Primary Examiner*—Sandra O'Shea
*Assistant Examiner*—Ismael Negron
(74) *Attorney, Agent, or Firm*—Gibbons, Del Deo, Dolan, Griffinger & Vecchione

(57) ABSTRACT

An method and apparatus that generates light at various up-angles. A planar surface having a plurality of LEDs equally spaced in a circular arc directs light at a conical reflector, which redirects the generated light in a 360-degree arc of light (i.e., light beam) that is then concentrated by a magnifying lens. The light beam has a small vertical angle of divergence and appears to originate from a point light source in the center of the conical reflector. A base assembly has mounting positions to which the planar surface, conical reflector and magnifying lens are secured and maintains the lantern in an up-right position. The base assembly includes a plurality of mounting positions for securing the planar surface at various predetermined distances from the conical reflector, thereby directing the generated light beam at a corresponding predetermined up-angle. In the preferred embodiment, light produced by four LEDs with 30-degree spreads is redirected by the 45-degree conical reflector to create a 360-degree arc of light outward from the conical reflector.

25 Claims, 4 Drawing Sheets

ADJUSTABLE UP-ANGLE LED LANTERN UTILIZING A MINIMAL NUMBER OF LIGHT EMITTING DIODES

FIELD OF THE INVENTION

The invention relates generally to lights or lanterns that incorporate light-emitting diodes (LEDs) as a light source.

BACKGROUND

Conventional lighting systems typically utilize an incandescent bulb as a light source. However, incandescent bulbs have a relatively short operating-life, tending to burn out as their filaments quickly become brittle and weaken due to aging and vibration. The consequential necessity for replacement of expired incandescent bulbs on a frequent basis is both expensive and time-consuming. Additionally, where colored light emission is needed, incandescent lights also require colored lenses, which decrease light transmission and often fade due to weathering and ultraviolet radiation. In contrast to incandescent bulbs, light emitting diodes (LEDs) are light sources with a long operating-life, and are able to generate light of various colors without the need for a colored lens. Furthermore, LEDs require low power to operate, are small in size, demand very low current, and are resistant to shock and vibration. For these reasons, LEDs are desirable light sources in flashlights, lanterns and similar lighting applications.

Optimally, the light emission path provided by a lantern covers an arc of 360-degrees, therefore making it desirable to use an onmidirectional light source placed in the center of a magnifying lens to project light and provide illumination. While incandescent bulbs are omnidirectional, LEDs are not. Nevertheless, for the reasons above stated, it is advantageous in other respects to utilize LEDs as light sources in lighting applications.

Early versions of lighting applications utilizing LEDs were marginally effective due to the low light-emitting energy and luminance provided by the LEDs. To overcome this limitation and address the need for an omnidirectional light source, one prior art lighting device places a multitude of LEDs projecting from a cylindrical support member, so that LED light is projected outward over a 360-degree arc. Another prior art lighting device projects LED light emitted from a multitude of planar-mounted LEDs toward a reflector positioned so as to redirect the light in a 360-degree arc parallel to the planar mounted LEDs. As in many conventional lighting applications, light from an LED array may also be passed through a magnifying lens to further distribute emitted and/or reflected light.

Unfortunately, the above mentioned attempts to construct a commercially viable lighting application utilizing LEDs still suffer from many disadvantages. In order to provide the required illumination, the prior art requires a large number of LEDs. Consequently, such a lighting application has excessive power consumption and an undesirably short operating-life during battery-powered operation. In contrast, the commercial requirement of a highly intense and efficient lighting device coupled with the limitations of LED light sources and the need for reasonable power consumption dictates that the energy in the visible spectrum be generated and utilized as efficiently as possible. In addition, depending on the lighting, application, generated light may be required to be focused in various desired directions. For example, in a beacon lighting system utilized to provide navigational aid, light must be directed at various up-angles. Despite these needs, prior art lighting applications fail to provide the desired efficiency or an easy adjustment method that allows light to be directed in a particular desired direction, for example, at a particular up-angle.

SUMMARY OF THE INVENTION

Accordingly, it is an objective of the invention to provide a compact and efficient lantern utilizing an arrangement of a minimal number of LEDs as a light source. It is also an objective of the invention to collect, direct and magnify the light generated by an such a minimal arrangement of LED light sources so as to maximize provided illumination and visibility. It is a further objective of the invention to provide a directional lighting device that is capable of being easily adjusted to supply light in a predetermined arc at various up-angles.

To that end, a lantern is provided that utilizes an arrangement of a minimal number of LEDs and a conical reflector to create a light source having a light source image with sufficient intensity to supply illumination in the intended lighting conditions. The conical reflector of the invention is positioned with its axis approximately orthogonal to a planar surface and the vertex of the conical reflector facing the planar surface. Arranged on the planar surface at a radial distance from the point of intersection with that surface of the axis of the conical reflector, LEDs are positioned around a 360-degree arc, with each LED equally spaced from adjacent LEDs on the arc. The radius of the circular arrangement of LEDs is smaller than the largest radius of the conical reflector and all LEDs are positioned to emit light toward the conical reflector in a direction perpendicular to the planar surface. By appropriate selection of the cone angle for the conical reflector and the distance between the LEDs and the conical reflector, the light source image may be positioned on the axis of the reflector. The cone-shape of the conical reflector also enables light that is incident the reflector, and thus reflected, to strike the reflector at horizontal angles beyond the light spread offered by an LED. In this manner, a 360-degree arc of light may be created using LEDs with small light spreads. In an exemplary case, a 45-degree conical reflector may be selected such that light produced by a minimum of only four LEDs with 30-degree light spreads may be redirected to create a 360-degree arc of light outward from the conical reflector.

Both the planar mounted LEDs and the conical reflector are surrounded by a transparent magnifying lens that concentrates the light produced in the 360-degree arc. Each of the planar surface, conical reflector and magnifying lens may be formed of molded plastic and joined to a relatively rigid base assembly that supports the lantern in an upright position. The distance between the planar surface and the conical reflector may be adjusted in order to vary the position of the light source image off the axis of the conical reflector, thereby directing the arc of light generated by the LEDs at various up-angles. For this purpose, the base assembly has a plurality of mounting positions that allow the planar surface (and thus the LEDs) to be secured at various predetermined distances from the conical reflector. Positioning the planar surface at a predetermined mounting positions results in the light generated by the lantern being directed at a corresponding predetermined up-angle. The base assembly may also house a power source and a control circuit for management of the application of power that illuminates the lantern.

BRIEF DESCRIPTION OF THE DRAWINGS

For a better understanding of the present invention, reference may be had to the following description of exemplary embodiments thereof, considered in conjunction with the accompanying drawings, in which.

DETAILED DESCRIPTION

A lantern according to the invention generates light suitable to illuminate an area under the intended lighting conditions utilizing an arrangement of a minimal number of light emitting diodes (LEDs). The minimal number of LEDs are arranged to direct light at a conical reflector, thereby creating a light source image that appears to be generated by a single omnidirectional light source and can replace conventional incandescent light sources used with standard lenses in conventional lanterns. The LEDs utilized by the lantern of the invention are readily available from a variety of manufacturing sources and incorporate technology that is well known in the art.

Figure 1:
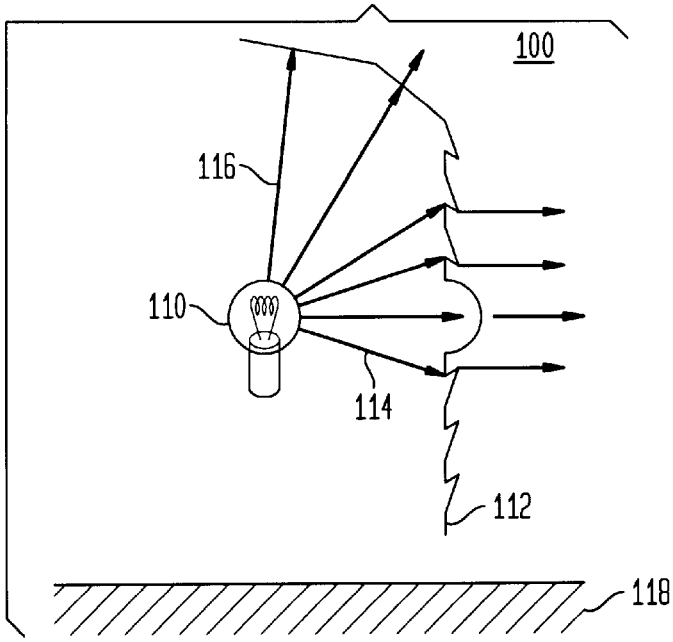
FIG. 1 (PRIOR ART)
FIG. 1 is a schematic representation of a lantern comprising an incandescent light source in a magnifying lens.

FIG. 1 depicts a conventional lantern 100 having an incandescent light source 110 disposed within a standard magnifying lens 112. The incandescent light source (i.e., lamp) 110 is placed in the center (i.e., at the focal point) of the lens and generates omnidirectional light. Light rays 114 generated by the light source are directed toward the magnifying lens 112, for example, a fresnel lens, which concentrates and redirects light rays 114 in a desired direction. Other light rays 116 generated by the incandescent light source are wasted because they are not directed toward the ridges of the magnifying lens 112. The magnifying lens 112 directs light rays 116 at a predetermined up-angle (angle of the directed light rays relative to a surface parallel to the surface on which the conventional lantern rests), depending on the position of the light source 110 within the magnifying lens 112.

Since the output of an LED lamp is unidirectional, achievement of the omnidirectional light output of a conventional incandescent lamp requires an arrangement of LEDs. Thus, when utilizing LEDs to replace a conventional omnidirectional incandescent light source in the center of the magnifying lens of a conventional lighting device, it is desirable to provide the light emitted by a plurality of LED light sources from a singular spot, so that a bright and omnidirectional light source image is formed.

Figure 2A:
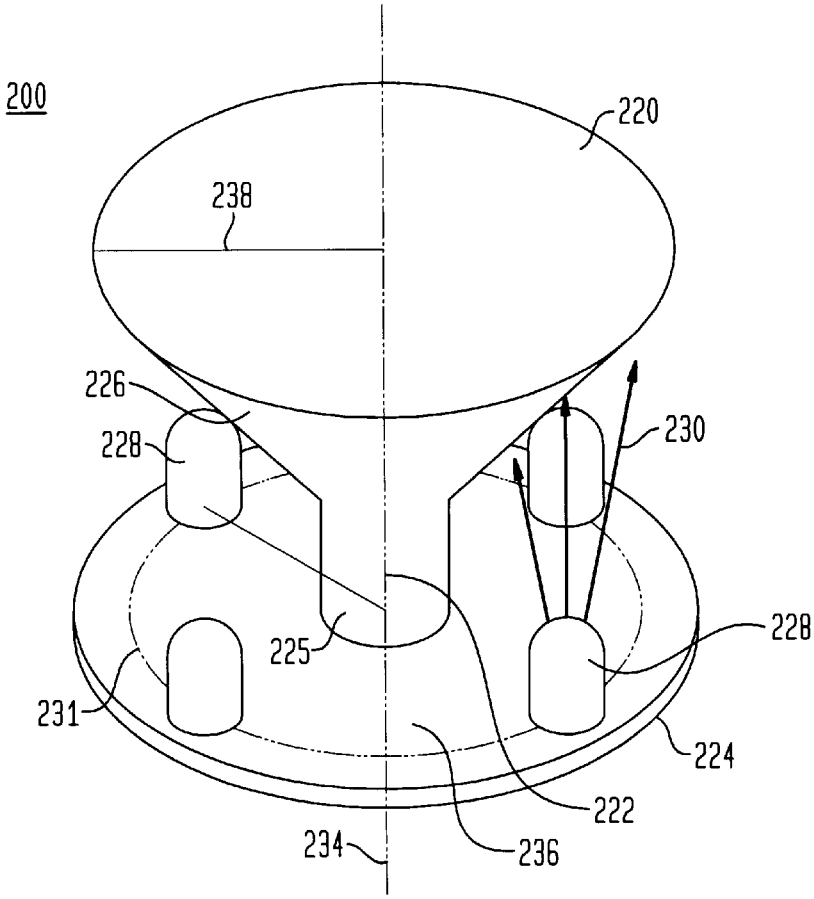
FIG. 2*a* is perspective view of a schematic representation of a omnidirectional light emitting diode light source according to the invention.
Figure 2B:
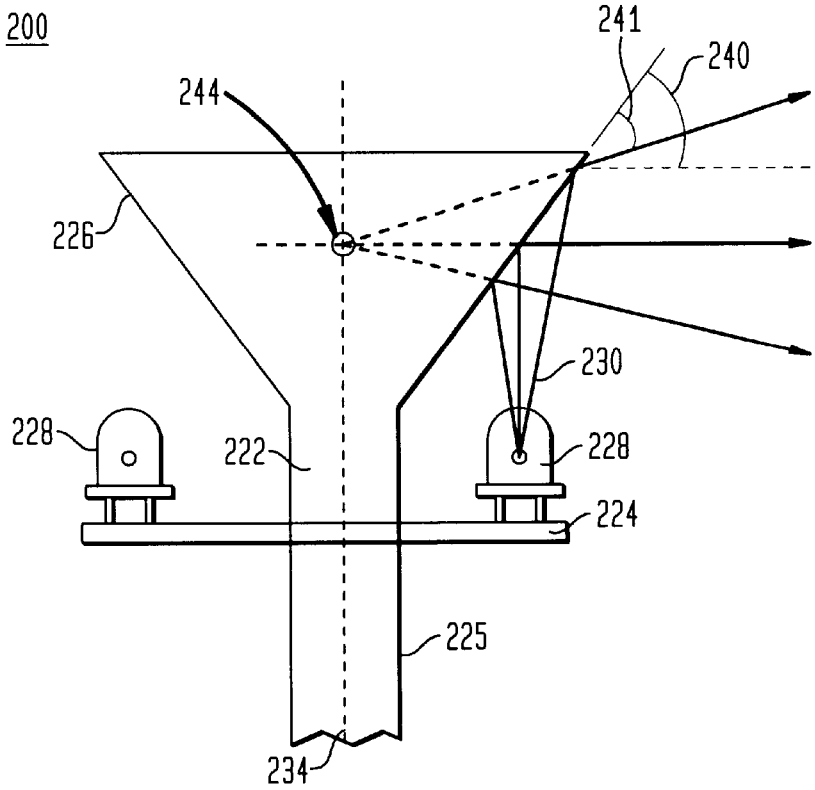
FIG. 2*b* is a side cross sectional view of the schematic representation of the omnidirectional light emitting diode light source of FIG. 2*a;*
Figure 2C:
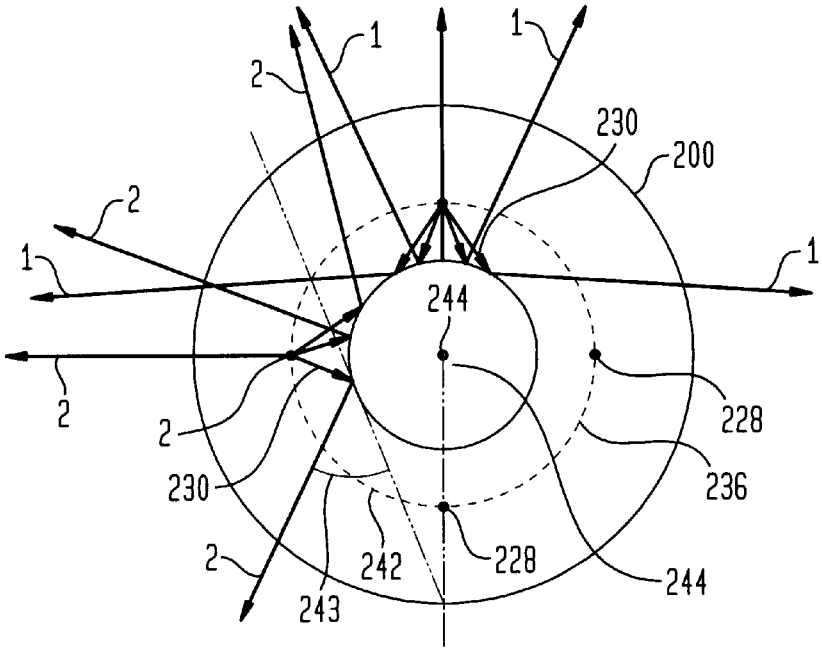
FIG. 2*c* is top cross sectional view of the schematic representation of the omnnidirectional light emitting diode light source of FIG. 2*a;*

FIGS. 2*a*–2*c* depict alternative views of an omnidirectional LED light source 200 according to the invention. FIG. 2*a* depicts a perspective view, FIG. 2*b* depicts a side cross sectional view, and FIG. 2*c* depicts a top cross sectional view of the omnidirectional LED light source. The omnidirectional LED light source of the invention converts the divergent light beams of a plurality of LEDs into a convergent 360-degree arc of light (i.e., light beam) that can be focused at selected areas in space.

As shown in the figures, the omnidirectional LED light source of the invention is created with a plurality of LEDs 228 and a conical reflector 220. The conical reflector 220 is positioned with its vertex 222 facing a planar surface 224, such as a printed circuit board. The conical reflector extends at its vertex into an extension member 225 aligned with its axis and approximately orthogonal to the planer surface. The extension member 225 passes through an aperture in the planar surface 224 and is adjustable relative to the planar surface, thereby permitting an adjustment of displacement of the vertex of the conical reflector from the planar surface. The conical reflector is preferably formed of molded plastic with its outer conical surface 226 coated with a lightweight reflective material. LEDs 228 are mounted on the planar surface 224 such that light rays 230 emitted by the LEDs will strike the outer reflective surface 226 of the conical reflector 220. Each LED 228 is mounted at a common radial distance 231 from the axis 234 of the conical reflector 220 (and, as well, the centerline of the aperture in the planar surface through which the extension member passes). In other words, the LEDs 228 are mounted in a circular arc 236 on the planar surface 224, with the center of the circular arc 236 aligned with the axis 234 of the conical reflector 220. The LEDs 228 are positioned to emit light toward the conical reflector 220 in a direction generally perpendicular to the planar surface 224. The radius 232 of the circular arrangement of LEDs is smaller than the largest radius 238 of the conical reflector such that all light generated by the LEDs strikes the conical reflector and is redirected to the magnifying lens, eliminating the waste of light as in the conventional incandescent lantern described in FIG. 1. through which the extension member passes). In other words, the LEDs 228 are mounted in a circular arc 236 on the planar surface 224, with the center of the circular arc 236 aligned with the axis 234 of the conical reflector 220. The LEDs 228 are positioned to emit light toward the conical reflector 220 in a direction generally perpendicular to the planar surface 224. The radius 232 of the circular arrangement of LEDs is smaller than the largest radius 238 of the conical reflector such that all light generated by the LEDs strikes the conical reflector and is redirected to the magnifying lens, eliminating the waste of light as in the conventional incandescent lantern described in FIG. 1.

It is well known in optics that the angle of light rays reflected by a reflective surface equals the angle of light rays incident on the reflective surface. For purposes of understanding the reflective properties of the invention, the conical reflector should be conceptualized as a multitude of reflective planar surfaces, each reflective planar surface tangential to a straight line passing through vertex 222 and running the length of the outer reflective surface 226 of the conical reflector. Each such conceptualized reflective planar surface has a planar vertical angle 240 relative to the planar surface 224 (the planar vertical angle equaling the cone angle) and a planar horizontal angle 242 relative to a plane bisecting of the conical reflector along its axis 234. Thus, the conical reflector provides a reflective surface having a singular planar vertical angle and a multitude of planar horizontal angles. Individual light rays generated by the LEDs are directed toward the conical reflector in variety of angles corresponding to the light spread of the LED. These light rays are incident on the conical reflector, striking the outer reflective surface 226 at a multitude of points, each of which can be represented by a conceptualized reflective planar surface tangent to the point struck. An incident light ray strikes a conceptualized reflective planar surface at a vertical angle 241 and a horizontal angle 243 relative to the conceptualized reflective planar surface.

Therefore, light rays 230 striking the outer reflective surface 226 are reflected at a vertical angle 241 dependent only on the LED light spread and the single planar vertical angle, 240. The planar vertical angle of the conical reflector reflects incident LED light into a vertical arc of light outward from the conical reflector. However, light rays strike the outer reflective surface 226 and are reflected at one of a multitude of horizontal angles 243 depending on the LED light spread and the point on the outer reflective surface 226 struck by the incident light ray. The multitude of horizontal angles provided by the conical shape of the reflector serve to ensure that the generated arc of light encompasses a 360-degree arc of light (i.e., light beam). In this manner, light rays are incident on the conical reflector (and consequently, reflected by the conical reflector) at angles beyond the light spread offered by an LED. The light generated by those LEDs arranged on the planar surface may be positioned to appear as a single light source image positioned in the center 244 of conical reflector, as shown in FIG. 2*b*.

As explained above, due to the conical shape of the reflector of the invention, a 360-degree arc of light can be achieved utilizing light emitted by a small number of LEDs having small light spreads, as shown in FIG. 2*c*. A 360-degree light arc directed outward from the conical reflector and substantially parallel to the planer surface is created with only four 30-degree light spread LEDs arranged in a circular arc 236 in a preferred embodiment of the invention. In such an arrangement, each LED on the circular arc is preferably spaced equally from adjacent LEDs to create a light beam of uniform intensity. The reduced number of LEDs utilized by such an arrangement, as compared to conventional LED lighting devices, conserves power in addition to providing increased illumination. Consequently, the lantern of the invention offers an intense light with an increased operating-life during battery powered operation.

In alternative embodiments of the invention, additional LEDs may be positioned on the circular arc of the planar surface to increase the intensity and uniformity of the emitted light, limited only by spatial constraints. The lantern of the invention may also be scaled to increase the radius, and thus the circumference of the circular arc available for LED positioning. Whatever the scale, however, for a given light output and pattern, the LED arrangement of the invention consistently requires a lesser number of LEDs than used by prior art lanterns, resulting in an efficient lantern that is simple to manufacture.

Figure 3:
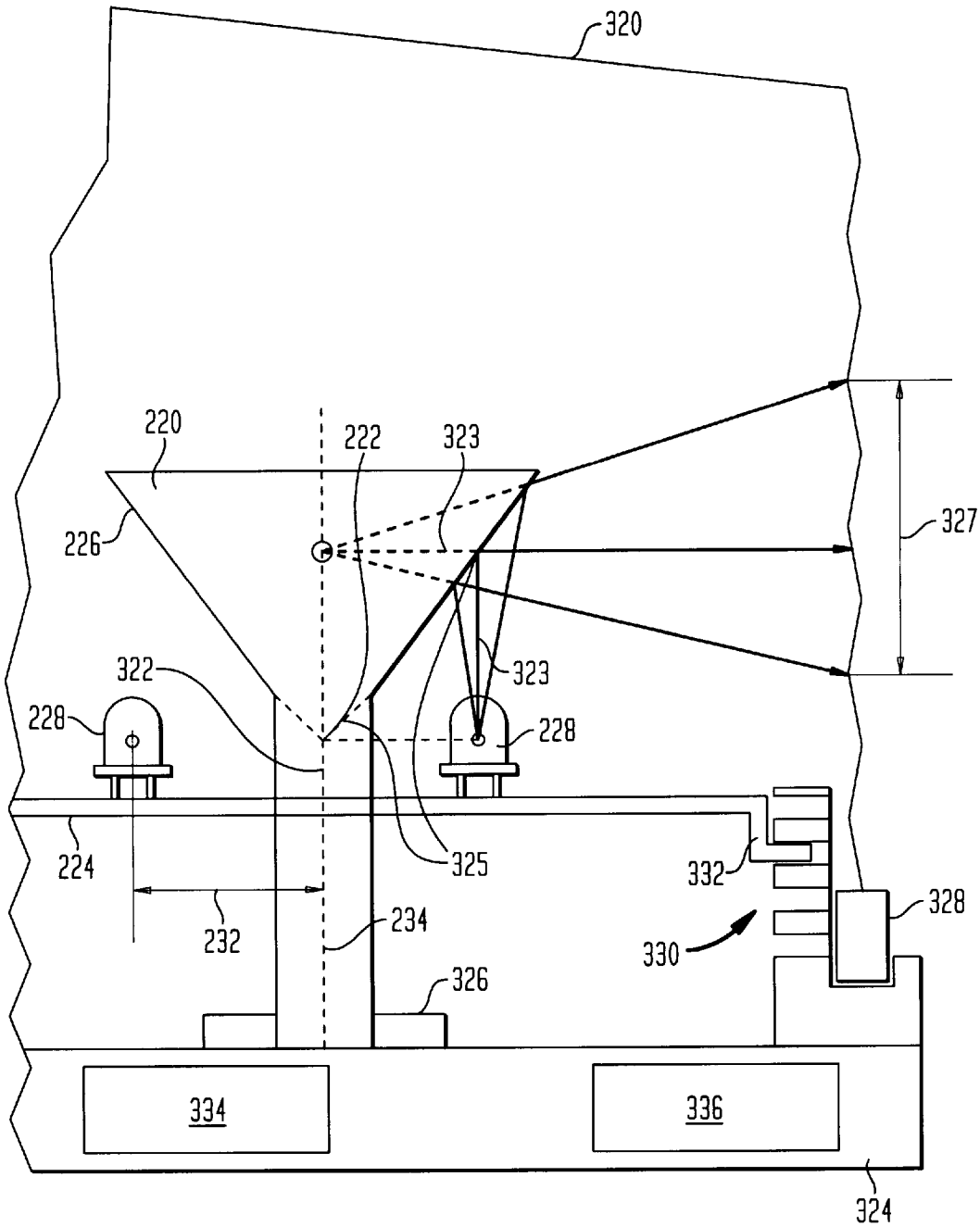
FIG. 3 is a schematic representation of an omnidirectional light emitting diode light source in a magnifying lens according to the invention.

FIG. 3 provides an illustrated view of the omnidirectional LED light source of the invention operated in a lantern configuration Specifically, the lantern configuration of the figure includes an omnidirectional LED light source 200 operated within an enclosing magnifying lens 320. When the lantern is viewed from an outside perspective, the arc of generated light (i.e., light beam) appears to originate from a light source image located on, or proximate to the axis of the conical reflector. The omnidirectional LED light source is positioned relative to the magnifying lens so as to place the axis of the light source image at the optical center (i.e., focal point) of the magnifying lens and thereby generate a particular up-angle (angle of reflected light ray that has passed through the magnifying lens relative to a surface parallel to the planar surface). Variation of the position of a light source image relative to the optical center of a magnifying lens alters the up-angle of the light directed by the magnifying lens. The spread of this generated light beam is easily and selectively adjustable according to the invention. the up-angle of the light directed by the magnifying lens. The up-angle of this generated light beam is easily an d selectively adjustable according to the invention.

For the illustrative embodiment of the invention described herein, a conical reflector having a 45-degree cone is assumed, because that angle simplifies somewhat the following discussion of distance and angular relationships associated with operation of the light source of the invention. It should, however, be understood that the invention is not limited to that cone angle. Those skilled in the art will readily understand the application of the LED light source of the invention using conical reflectors having other cone angles.

As previously described, LEDs 228 are positioned in a circular arc on planar surface 224, and located on a fixed radius 232 from the axis 234 of conical reflector 220 passing therethrough. With this arrangement, the planar surface may be positioned a distance 322 from the vertex 222 of the conical reflector 220 (and correspondingly the LEDs a distance from the outer reflective surface 226 of the conical reflector) such that the light source image created by the LEDs appears to emanate from a point on the axis of the conical reflector. As the cone angle is 45-degrees, the distance from the LEDs to the conical reflector is directly translated into the distance 323 that the light source image appears in the interior of the conical reflector (when the LEDs light source, approximated by the planar surface, is located tangential to the vertex, a 45-45-90 triangle is formed). Since the LEDs are positioned on a circular arc, each LED reinforces the light source image at a single point on the axis of the conical reflector. Light from this single light source image strikes the magnifying lens 320 at an area 327 in 360 degree ring (i.e., annular ring) around the magnifying lens. This, in turn, ensures that the vertical angle of the 360-degree arc of light generated by the light source (i.e., light beam) is substantially narrow. In contrast, multiple light source images would provide light to differing areas around the magnifying lens and creating a more diffuse light beam.

The planar surface 224 (and correspondingly, each LED 228 on the planar surface) is also located a preselected distance 322 from a reference point on the conical reflector, here its vertex. Given the 45-degree cone for the conical reflector of the invention (angles 325 are both 45-degrees), creation of the light source image on the axis of the conical reflector requires a one-to-one relationship between radius 232 of the circular arc in which the LEDs are mounted and the distance between the planar surface 224 and the conical reflector vertex 222.

A magnifying lens 320, preferably having a cylindrical configuration, surrounds the LED/conical reflector arrangement and concentrates the 360-degree arc of light produced by the omnidirectional LED light source. The magnifying lens may be selected from various transparent magnifying lenses, including but not limited to fresnel lenses, which direct gathered light in a singular outward direction. The light source image (positioned at 244) created by the LEDs is positioned at the center (i.e., focal point) of the magnifying lens 320. When the light source image is so positioned at the focal point and maintained on the axis 234 of the conical reflector, the magnifying lens provides a light pattern with a predetermined up-angle from the planar surface.

The spread of the light beam provided by the light source image can be altered to thereby provide a beacon light at various spreads by modifying the distance 322 between the planar surface and the vertex of the conical reflector (i.e., moving the planer surface vertically). This action moves the light source image from the axis of the conical reflector in a direction normal to the axis and, as well, moves the light source image from the center (i.e., focal point) of the magnifying lens (i.e, moves the light source image horizontally). With the illustrative 45-degree cone of the conical reflector, which forms a 45-45-90 triangle with the planar surface, moving the planar surface of LEDs vertically causes the light source image on the conical reflector to move a corresponding distance horizontally. Thus, placing the planer surface closer to the conical reflector makes the light source image generated by each LED appear closer to the outer surface of the conical reflector, and thus closer to the magnifying lens. When the light source is positioned closer to the magnifying lens, the spread of the light beam is increased.

The spacing and angle relationships described above may be usefully compared with movement of an incandescent lamp from the center (i.e. focal point) of a magnifying lens in a conventional lantern. Consider, for example, moving an incandescent lamp offcenter to the right, which will increase the light beam spread out the right side of the magnifying lens in a conventional lantern. However, since the incandescent lamp also moves away from opposing side of the magnifying lens, the light beam will also narrow on the opposing side of a conventional lantern.

In the LED lantern of the invention, when the light source image is moved offcenter (relative to the axis of the conical reflector and the center of the magnifying lens) by altering the distance between the planar surface and the conical reflector, the light source image moves equally toward/away from all sides of the magnifying lens. The greater the distance 322 between the LEDs on planar surface and the vertex of the conical reflector, the more the light source image appears to be displaced behind the axis of the conical reflector 220. This also correspondingly displaces the light source image from the focal point of the magnifying lens. Thus, as the planar surface is moved away from the conical reflector, the up-angle of the generated light beam decreases on both sides of the magnifying lens in the lantern of the invention. Unlike prior-art light source designs, which are uniquely arranged to work with the size of a specific magnifying lens, the method of the invention, whereby the distance between the planar surface and the conical reflector is adjustable, allows the light source of invention to work well in various diameter magnifying lens.

With continuing reference to FIG. 3, the lantern of the invention is assembled by joining the planar surface 224, conical reflector 220 and magnifying lens 320 to a relatively rigid base assembly 324 that supports the lantern in an upright position. In a preferred embodiment, molded mounting positions are provided in the base assembly 324 into which each of the planar surface, conical reflector and magnifying lens may be secured. The conical reflector 220 is secured to a single set of reflector mounting positions 326. The magnifying lens 320 is secured to a single set of lens mounting positions 328. The planar surface 224 is secured to one of a plurality of planar mounting positions 330. As explained above, the arc of light generated by the lantern of the invention may be directed at various up-angles by adjusting the distance 232 between the planar surface and the vertex of the conical reflector. To that end, the plurality of planar mounting positions 330 in the base assembly 320 allow the planar surface 224, on which the LEDs 228 are mounted, to be secured at various predetermined distances from the conical reflector 220, thereby establishing a corresponding plurality of predetermined up-angles. A member 332 extending from the planar surface 224 engages the openings of the mounting positions and locks the planar surface into position.

Figure 4A:
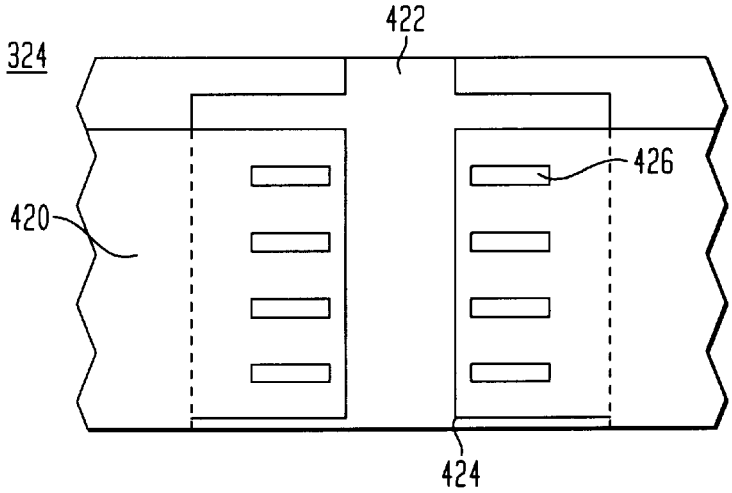
FIG. 4*a* is a schematic representation of a sidewall of a base assembly of a lantern according to the invention in an exemplary embodiment.
Figure 4B:
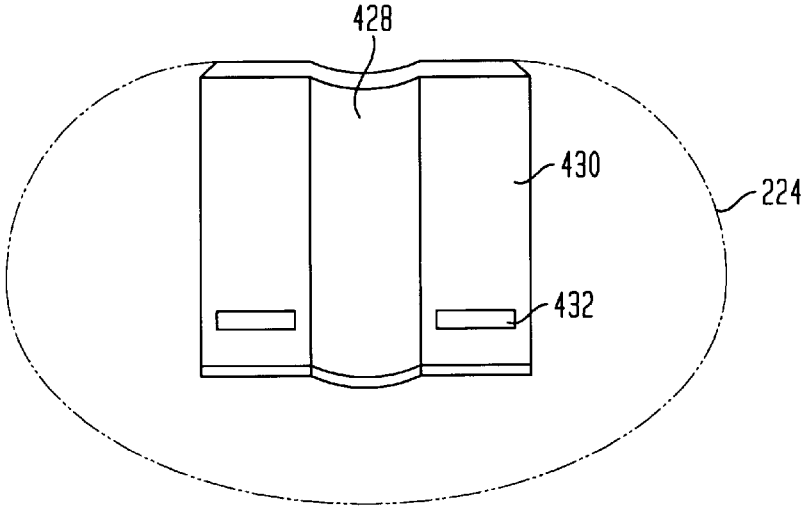
FIG. 4*b* is a perspective view a schematic representation of an exemplary connection means for securing the planar surface of the lantern according to the invention.
Figure 4C:
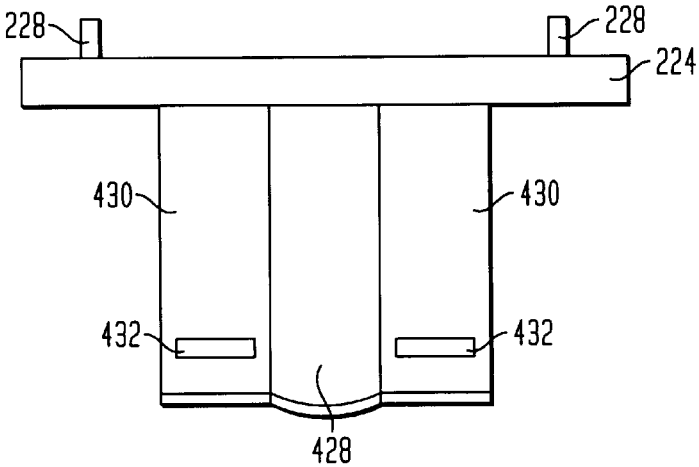
FIG. 4*c* is a side cross sectional view of the schematic representation of an exemplary connection means for securing the planar surface of FIG. 4*b*. In the detailed description below, like reference numerals are used to describe the same, similar or corresponding elements in FIGS. 1–4*c*.

An alternative method of securing the planar surface to the base assembly a given distance from the reflector is depicted by the schematic representations in FIG. 4*a–c*. FIG. 4*a* depicts a sidewall 420 of the base assembly 324 of a lantern according to the invention. The sidewall 420 has a slot 422 that spans the sidewall's length, with the inner surface of the edges 424 of the slot having multiple indentations 426. The planar surface 224 is adjustably mounted on the slot edges 424 at predetermined distances from the reflector. FIG. 4*b* depicts a perspective view of an exemplary connection means for securing the planar surface in a predetermined location. FIG. 4*c* depicts a side view of the exemplary connection means for securing the planar surface. A bar-shaped piece 428 extends perpendicularly from the planar surface 224 and has a width which is slightly smaller than the slot 422 opening width so that the bar shaped piece 428 can slide in the slot 422 along the slot length. A surface 430 (denoted as "bar surface" herein) extends on either side of the bar piece 428 parallel to the base assembly sidewall 420. The bar surface 430 rides in the slot 422, allowing the bar shaped-piece to slide along the slot. A tooth 432 on either side of the bar piece protrudes from the bar-surface 420. These teeth 432 are positioned to engage the indentations 426 on the inner surface of each slot edge to lock the bar piece and thus the planar surface in position. The planar surface 224 freely slides along the slot 422 and may lock at a location by engaging the bar surface teeth 432 to the indentations 426. In essence, the teeth and the indentations form a rachet type of mechanism. The planar surface is able to translate along the base assembly length to accommodate positioning the planar surface at various predetermined distances from the reflector, and thereby direct light at corresponding predetermined up-angles.

Any of a number of alternative connection means known in the art may be utilized to provide for attachment of the planar surface to the base assembly. For example, a threaded hole that accepts a screw could be positioned on the planar surface. The screw could then be adjusted to vary the distance between the planar surface and the reflector. In another alternative embodiment, a plurality of mounting positions may be provided in the magnifying lens. The planar surface would then be secured to one of the predetermined mounting positions provided in the magnifying lens in order to alter the up-angle of the generated light beam.

Referring again to FIG. 3, the base assembly 324 may also house a power source 334 and/or a control circuit 336 for control of the application of power that illuminates the lantern. Alternatively, a power source to illuminate the LEDs may be housed external to the base assembly of the lantern. In another alternative embodiment, the lantern control circuit includes a timing circuit that intermittently supplies power to the lantern, thereby creating a strobe light.

Conclusion:

There has been described and illustrated herein, an apparatus for generating a light at various up-angles from an arrangement of a minimal number of light emitting diodes (LEDs). The lantern of the invention provides an efficient and effective light source from an arrangement of LEDs, a conical reflector, and a magnifying lens, all mounted on a base assembly. The vertex of the conical reflector faces the planar surface on which LEDs are equally spaced in a circular arc with a radius smaller than the largest radius of the conical reflector. The conical reflector redirects light incident from the LEDs in a 360-degree arc of light (i.e., light beam). The magnifying lens concentrates the light beam, which may be directed at various up-angles by adjusting the distance of the planar surface from the conical reflector. The base assembly includes a plurality of molded mounting positions for securing the planar surface at various predetermined distances from the conical reflector, thereby directing the light beam at corresponding predetermined up-angles.

It is to be understood that the invention is not limited to the illustrated and described forms and embodiments contained herein. It will be apparent to those skilled in the art that various changes using different configurations and functionally equivalent components and programming may be made without departing from the scope of the invention. Thus, the invention is not considered limited to what is shown in the drawings and described in the specification and all such alternate embodiments are intended to be included in the scope of this invention as set forth in the following claims.

What is claimed is:

1. An omnidirectional LED light source comprising:

a planar surface;

a plurality of light emitting diodes mounted on said planar surface, said plurality of light emitting diodes arranged to emit light in a direction perpendicular to said planar surface;

a conical reflector having a single vertex and with an outer surface having a single vertical planar angle of 45 degrees disposed about an axis, said reflector positioned to intersect said light emitted by said plurality of light emitting diodes, said reflector operative to create a light source image appearing to emanate from a location proximate said axis of said reflector, said reflector redirecting said light outwardly through a predetermined arc;

a means for adjusting a distance between said planar surface and said reflector to vary the location of said light source image.

2. The omnidirectional LED light source as claimed in claim 1, wherein said plurality of light-emitting diodes comprises:

at least four light emitting diodes, each said light emitting diode is of the type having a 30-degree light, each said light diode positioned on a circular arc at a radial distance from an axis of said reflector, each light emitting diode equidistant from adjacent of said light emitting diodes.

3. The omnidirectional LED light source as claimed in claim 1, further including a control circuit for selectively controlling the application of power to said plurality of light-emitting diodes.

4. The omnidirectional LED light source as claimed in claim 1 further including a base assembly for supporting said planar surface and said reflector, wherein said means for adjusting said distance between said planar surface and said reflector comprises:

a plurality of mounting positions for said planar surface extending perpendicularly through said base assembly, each mounting position establishing a predetermined distance between said planar surface and said reflector, correspondingly varying said location of said light source image.

5. The omnidirectional LED light source as claimed in claim 1 further including a base assembly for supporting said planar surface and said reflector, wherein said means for adjusting said distance between said planar surface and said reflector comprises:

a slot spanning a length of said base assembly;

a plurality of indentations on an inner surface of said base assembly proximate to edges of said slot;

a surface piece, connected to said planar surface engaging a bottom surface of said slot edges comprising two teeth wherein each tooth locks against said indentations forming a rachet type mechanism, wherein said surface piece connected to said planar surface can slide along said slot and lock at any indentation.

6. The omnidirectional LED light source as claimed in claim 1, wherein said means for adjusting said distance between said planar surface and said reflector comprises:

a threaded hole in said planar surface;

a screw positioned in said threaded hole, wherein said screw can be turned.

7. The omnidirectional LED light source as claimed in claim 1, further including a magnifying lens surrounding said planar surface and said reflector.

8. The lantern as claimed in claim 1, wherein said reflector is a conical reflector having a 45-degree cone and a vertex.

9. The omnidirectional LED light source as claimed in claim 1, wherein each of said plurality of light-emitting diodes:

is positioned on a circular arc at a radial distance from an axis of said reflector, and is equidistant from adjacent of said light emitting diodes.

10. The omnidirectional LED light source as claimed in claim 9 wherein said radial distance of said circular arc of said plurality of light-emitting diodes is smaller than the largest of said radii of said, reflector.

11. The omnidirectional LED light source as claimed in claim 1, wherein said reflector is positioned such that said single vertex points toward said planar surface.

12. The omnidirectional LED light source as claimed in claim 11, wherein said reflector further includes a extension member extending from said vertex of said reflector, said extension member aligned with an axis of said reflector and approximately orthogonal to said planar surface, said planar surface having an aperture, said extension member passing through said aperture and adjustable relative to said planar surface.

13. A lantern comprising:

a planar surface;

a plurality of light-emitting diodes mounted on said planar surface, said plurality of light -emitting diodes arranged to emit light in a direction perpendicular to said planar surface;

a conical reflector having a single vertex and with an outer surface having a single vertical planar angle of 45 degrees disposed about an axis, said reflector positioned to intersect said light emitted by said plurality of light emitting diodes, said reflector operative to create a light source image appearing to emanate from a location proximate said axis of said reflector, said reflector redirecting said light outwardly through a predetermined arc;

a magnifying lens surrounding said planar surface and said reflector; and a means for adjusting a distance between said planar surface and said reflector to vary the location of said light source image within said magnifying lens, thereby varying the spread of said light redirected outwardly through said predetermined arc.

14. The lantern as claimed in claim 13, wherein said plurality of light-emitting diodes comprises;

at least four light emitting diodes, each of said light emitting diode is of the type having a 30-degree light, each said light emitting diode positioned on a circular arc at a radial distance from an axis of said reflector, each light emitting diode equidistant from adjacent of said light emitting diodes.

15. The lantern as claimed in claim 13, wherein said predetermined arc is a 360-degree arc.

16. The lantern as claimed in claim 13, further including a control circuit for selectively controlling the application of power to said plurality of light-emitting diodes.

17. The lantern as claimed in claim 13 further including a base assembly for supporting said planar surface, said reflector and said magnifying lens in an upright position, wherein said means for adjusting said distance between said planar surface and said reflector comprises:

a plurality of mounting positions for planar surface extending perpendicularly through said base assembly, each mounting position establishing a predetermined distance between said planar surface and said reflector.

18. The lantern as claimed in claim 13 further including a base assembly for supporting said planar surface, wherein said means for adjusting said distance between said planar surface and said reflector comprises:

a slot spanning a length of said base assembly;

a plurality of indentations on an inner surface of said base assembly proximate to edges of the slot;

a surface piece, connected to said planar surface engaging a bottom surface of said slot edges comprising two teeth wherein each tooth locks against said indentations forming a rachet type mechanism, wherein said surface piece connected to said planar surface can slide along said slot and lock at any indentation.

19. The lantern as claimed in claim 13, wherein said means for adjusting a distance between said planar surface and said reflector comprises:

a threaded hole in said planar surface;

a screw positioned in said threaded hole, wherein said screw can be turned.

20. The lantern as claimed in claim 13, wherein each of said plurality of light-emitting diodes:

is positioned on a circular arc at a radial distance from an axis of said reflector, and is equidistant from adjacent of said light emitting diodes.

21. The lantern as claimed in claim 20, wherein said radial distance of said circular arc of said plurality of light-emitting diodes is smaller than the largest of said radii of said reflector.

22. The lantern as claimed in claim 14, wherein said reflector is positioned such that said single vertex points toward said planar surface.

23. The lantern as claimed in claim 22, wherein said reflector further includes a extension member extending from said vertex of said reflector, said extension member aligned with an axis of said reflector and approximately orthogonal to said planar surface, said planar surface having an aperture, said extension member passing through said aperture and adjustable relative to said planar surface.

24. A lantern for directing light at various up-angles, said lantern comprising:

a planar surface;

a plurality of light-emitting diodes mounted on said planar surface, said plurality of light-emitting diodes arranged to emit light in a single direction perpendicular to said planar surface;

a conical reflector having an interior, said conical reflector having a single vertex and with an outer surface having a single vertical planar angle of 45 degrees, said reflector positioned to intersect said light emitted by said plurality of light emitting diodes, said reflector operative to create a light source image appearing to emanate from a location within said interior of said reflector, said reflector redirecting said light outwardly through a predetermined arc;

a magnifying lens surrounding said planar surface and said reflector;

a base assembly for supporting said planar surface, said reflector and said magnifying lens in an up-right position;

a slot spanning a length of said base assembly;

a plurality of indentations on an inner surface of said base assembly proximate to edges of said slot; and a surface piece, connected to said planar surface engaging a bottom surface of said slot edges comprising two teeth wherein each tooth locks against said indentations forming a ratchet type mechanism, wherein said surface piece connected to said planar surface can slide along said slot and lock at any indentation to vary said location of said light source image within said magnifying lens, thereby varying the spread of said light redirected outwardly through said predetermined arc.

25. A lantern for directing light at various up-angles comprising:

a planar surface, said planar surface having a threaded hole and an aperture;

a plurality of light-emitting diodes mounted on said planar surface, said plurality of light-emitting diodes arranged to emit light in a single direction perpendicular to said planar surface;

a conical reflector having an interior, said conical reflector having a single vertex and with an outer surface having a single vertical planar angle of 45 degrees, said reflector positioned to intersect said light emitted by said plurality of light emitting diodes, said reflector operative to create a light source image appearing to emanate from a location within said interior of said reflector, said reflector redirecting said light outwardly through a predetermined arc, said reflector having a member extending through said aperture of said planar surface;

a magnifying lens surrounding said planar surface and said reflector; and a screw positioned in said threaded hole, said screw being able to be turned to adjust a distance between said planar surface and said reflector surface to vary said location of said light source image within said magnifying lens, thereby varying the spread of said light redirected outwardly through said predetermined arc.

* * * * *